US005871297A

United States Patent [19]

Rogers et al.

[11] Patent Number: 5,871,297

[45] Date of Patent: Feb. 16, 1999

[54] FLUID DISPENSER

[76] Inventors: Thomas L. Rogers, 23300 Providence Dr., Apt. 514, Southfield, Mich. 48075; Lydell Woods, P.O. Box 21003, Detroit, Mich. 48221

[21] Appl. No.: 833,022

[22] Filed: Apr. 3, 1997

[51] Int. Cl.[6] ..... A46B 11/02; A47L 13/17; A47L 13/22

[52] U.S. Cl. ..... 401/146; 401/150; 401/151; 401/180

[58] Field of Search ..... 401/146, 150, 401/149, 180, 151

[56] References Cited

U.S. PATENT DOCUMENTS

| | | | |
|---|---|---|---|
| 712,580 | 11/1902 | Herfert . | |
| 1,484,920 | 2/1924 | Wolfe . | |
| 1,485,126 | 2/1924 | Schumacher . | |
| 1,978,757 | 10/1934 | O'Keefe et al. | 401/150 |
| 2,305,158 | 12/1942 | Hanses | 401/180 X |
| 2,308,078 | 1/1943 | Hendrickson | 401/146 X |
| 2,770,828 | 11/1956 | Ellman | 401/146 |
| 3,036,327 | 5/1962 | Crawford . | |
| 3,118,166 | 1/1964 | Bell . | |
| 4,171,171 | 10/1979 | Jones . | |
| 4,237,822 | 12/1980 | Kaiser, Jr. . | |
| 4,640,638 | 2/1987 | Bokmiller et al. . | |
| 4,692,047 | 9/1987 | Endo . | |
| 4,728,009 | 3/1988 | Schmidt . | |
| 4,764,044 | 8/1988 | Konose . | |
| 4,787,765 | 11/1988 | Kuo . | |
| 5,087,138 | 2/1992 | Terbrusch et al. . | |
| 5,088,849 | 2/1992 | Johnson et al. . | |
| 5,096,321 | 3/1992 | Mountain | 401/150 X |
| 5,158,383 | 10/1992 | Glover et al. . | |
| 5,393,153 | 2/1995 | Bouthillier et al. . | |

FOREIGN PATENT DOCUMENTS

| | | |
|---|---|---|
| 0 193 299 | 9/1986 | European Pat. Off. . |
| 546093 | 6/1942 | United Kingdom . |
| 890052 | 2/1962 | United Kingdom . |

*Primary Examiner*—Steven A. Bratlie
*Attorney, Agent, or Firm*—Brooks & Kushman P.C.

[57] ABSTRACT

A fluid dispenser comprises an applicator portion, a handle portion, a pump, a valve, a first piston, a first resilient device, a second piston, and a second resilient device. The handle portion defines a pump support section and a reservoir. The pump support section includes the pump and a premeasure cavity. The valve is moveable between a normally closed position and an open position. The first piston moves in the reservoir and has the first resilient device biasing the piston for pushing fluid from the reservoir to move the valve to its open position so that fluid flows from the reservoir to the premeasure cavity to fill the premeasure cavity with a first premeasured charge of fluid. The valve moves back to its normally closed position after the premeasure cavity is filled. The second piston moves in one direction in the premeasure cavity and pushes the first premeasured charge of fluid from the premeasure cavity to the applicator portion. The second resilient device in the premeasure cavity moves the second piston in a second direction and in cooperation with the bias of the first resilient device facilitates the movement of the valve to its open position so that a second premeasured charge of fluid may be sucked from the reservoir into the premeasure cavity.

17 Claims, 4 Drawing Sheets

FLUID DISPENSER

TECHNICAL FIELD

This invention relates to a fluid dispenser for measuring and applying fluids to the human body.

BACKGROUND ART

Dispensers or brushes known in the art for applying fluids to the human body have utilized several different types of fluid dispensing means. For example, U.S. Pat. No. 5,087,138 issued to Terbrusch et al. on Feb. 11, 1992 discloses a fluid dispenser utilizing the force of gravity to dispense a fluid to an applicator pad; U.S. Pat. No. 712,530 issued to Herfert on Nov. 4, 1902 discloses a fluid dispenser utilizing a single piston means to dispense a fluid; and, U.S. Pat. No. 5,088,849 issued to Johnson et al. on Feb. 18, 1992 discloses a fluid dispenser utilizing a pumping means to expel two different liquids to an applicator pad.

Fluid dispensers with user-controlled pump dispensing means are also known in the art. For example, U.S. Pat. No. 4,171,171 issued to Jones on Oct. 16, 1979 discloses a fluid dispenser utilizing expulsion means to dispense a first charge of fluid from a reservoir and suction means to refill the reservoir with a second charge of fluid for expulsion thereafter. Similarly, U.S. Pat. No. 4,692,047 issued to Endo on Sep. 8, 1987 also discloses a fluid dispenser utilizing expulsion means to dispense a first charge of fluid from a reservoir and suction means to refill the reservoir with a second charge of fluid for expulsion thereafter. However, such conventional or known fluid dispensers with user-controlled pump dispensing means do not provide the improved functions and structure of the present invention.

SUMMARY OF THE INVENTION

An object of this invention is to provide an improved fluid dispenser. In carrying out this object and others, the invention is a fluid dispenser comprising an applicator portion, a handle portion, a pump, a valve, a first piston having a first resilient device, and a second piston having a second resilient device. The handle portion defines a pump support section and a reservoir section having a reservoir adapted to receive fluid. The pump support section includes the pump, the pump having a premeasure cavity, and inlet and outlet passageways in selective fluid flow communication with the reservoir and the applicator portion respectively. The valve, which is located between the inlet and outlet passageways, is moveable to an open position blocking fluid flow communication between the premeasure cavity and the outlet passageway and establishing fluid flow communication between the premeasure cavity and the reservoir. Further, the valve is moveable to a normally closed position blocking fluid flow communication between the premeasure cavity and the reservoir and establishing fluid flow communication between the premeasure cavity and the outlet passageway. The first piston moves in the reservoir and has a first resilient device biasing the piston for pushing fluid from the reservoir to move the valve from its normally closed position to its open position so that fluid is allowed to flow from the reservoir to the premeasure cavity to fill the premeasure cavity with a first premeasured charge of fluid. The valve moves to its normally closed position after the premeasure cavity is filled. The second piston moves in one direction in the premeasure cavity and pushes the first premeasured charge of fluid from the premeasure cavity through the outlet passageway to the applicator portion. The second resilient device is in the premeasure cavity to move the second piston in a second direction and in cooperation with the bias of the first resilient device facilitates the movement of the valve to its open position so that a second premeasured charge of fluid may be sucked from the reservoir into the premeasure cavity.

In an alternative embodiment, an improved fluid dispenser comprises an applicator portion, a handle portion, a pump, a valve, a first piston, a first resilient device, a second piston, and a second resilient device. The handle portion defines a pump support section and a reservoir section having a reservoir adapted to receive fluid. The pump support section includes the pump, a premeasure cavity, and inlet and outlet passageways in fluid flow communication with the reservoir and the applicator portion respectively. The valve, which is located between the inlet and outlet passageways, is moveable to an open position blocking fluid flow communication between the premeasure cavity and the outlet passageway and establishing fluid flow communication between the premeasure cavity and the reservoir. Further, the valve is moveable to a normally closed position blocking fluid flow communication between the premeasure cavity and the reservoir and establishing fluid flow communication between the premeasure cavity and the outlet passageway. The first piston moves in the reservoir and has a first resilient device biasing the piston for pushing fluid from the reservoir to move the valve from its normally closed position to its open position so that fluid is allowed to flow from the reservoir to the premeasure cavity to fill the premeasure cavity with a first premeasured charge of fluid. The valve moves to its normally closed position after the premeasure cavity is filled. The second piston moves in one direction in the premeasure cavity and pushes the first premeasured charge of fluid from the premeasure cavity through the outlet passageway to the applicator portion. The second resilient device is in the premeasure cavity to move the second piston in a second direction and in cooperation with the bias of the first resilient device facilitates the movement of the valve to its open position so that a second premeasured charge of fluid may be sucked from the reservoir into the premeasure cavity.

In a more specific embodiment, the valve includes a flapper hinged between said inlet and outlet passageways.

In another more specific embodiment, the improved fluid dispenser has an insertable stop to prevent the dispensing of fluid while the reservoir is being filled.

In another more specific embodiment, the improved fluid dispenser includes a locator grommet to locate the outlet passageway with respect to the inlet passageway and an opening in the pump support section.

In another more specific embodiment, the first and second valves include flappers.

In yet another more specific embodiment, the first and second valves include check balls and peg stops.

An advantage of the present invention is that it utilizes a pair of pistons which cooperate using both suction and expulsion to fill, dispense, and refill from a reservoir premeasured charges of fluid from a hand-held fluid dispenser.

The above objects, features, and advantages of the present invention will be readily apparent from the following detailed description of the best mode for carrying out the invention when taken in conjunction with the accompanying drawings.

While embodiments of this invention are illustrated and disclosed, these embodiments should not be construed to limit the claims. It is anticipated that various modifications and alternative designs may be made without departing from the scope of this invention.

BEST MODE FOR CARRYING OUT THE PRESENT INVENTION

Figure 1:
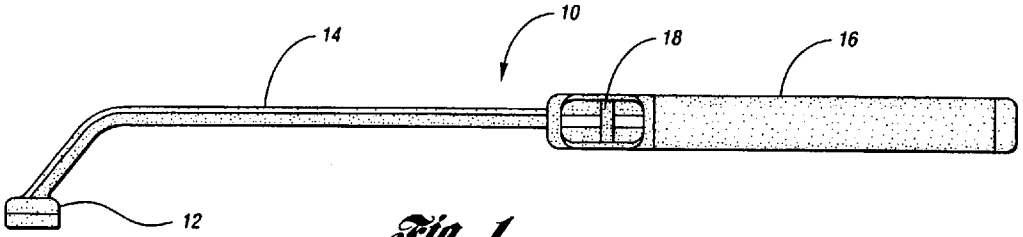
FIG. 1 is a side elevational view of a fluid dispenser according to the present invention.

FIG. 1 shows a fluid dispenser 10 including an applicator head portion 12, an extension tube 14, and a handle portion 16 is shown. Attached to handle portion 16 is an actuating push button or trigger 18 for controlling the delivery of a fluid to the applicator head portion 12. Extension tube 14 is ergonomically designed to enable a user to comfortably hold handle portion 16 as the applicator head portion 12 remains in full contact with the user's body. Preferably, extension tube 14 is of sufficient length to enable the user to reach their entire back.

Figure 2:
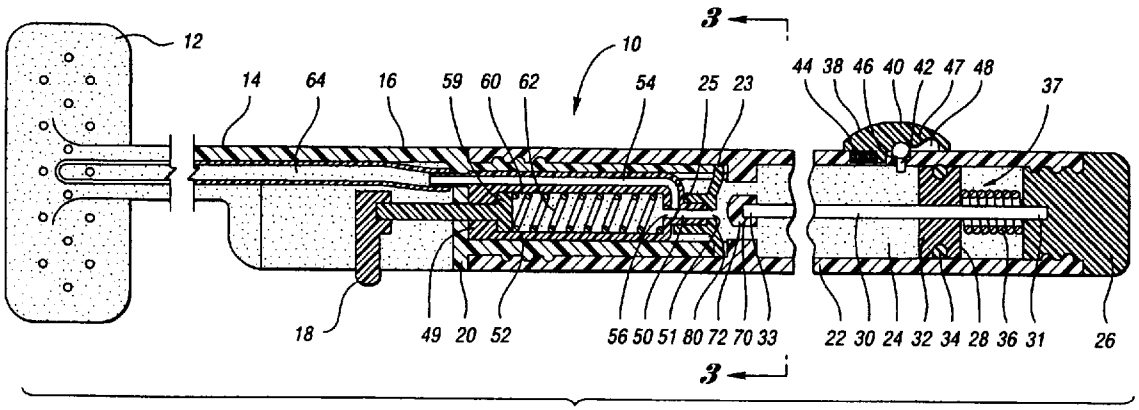
FIG. 2 is a fragmentary cross-sectional view of the fluid dispenser with a portion of the dispenser broken away to show a fluid delivery system including pump support and reservoir sections.

FIG. 2 shows a cross-sectional view of the fluid dispenser 10 with portions of the handle portion 16 and extension tube 14 broken away to show a fluid delivery mechanism. Fluid dispenser 10 includes a pump support section 20 and a reservoir section 22. Reservoir section 22 is shown separately in FIG. 7. Pump support section 20 is shown separately in FIG. 8. As explained following in more detail, a locator grommet 23 is used to position the pump support section 20 with respect to the reservoir section 22.

Reservoir section 22 includes a reservoir 24 to receive a fluid. A cap 26 provides the user access to fill the reservoir 24 with fluid. A piston 28 forces fluid in reservoir 24 toward pump support section 20. Cap 26 is adapted to screw into the end of reservoir 24 opposite pump support section 20. Piston 28 has a guide rod 30, a head 32, an o-ring 34, and a resilient device 36.

Preferably, resilient device 36 is a spring or other like biasing device. Guide rod 30 has a proximate end 31 and a distal end 33. The proximate end 31 of guide rod 30 is permanently attached to cap 26. Resilient device 36 and head 32 are slidably attached along the axis of guide rod 30 with resilient device 36 positioned between cap 26 and head 32. With cap 26 fully secured in the end of reservoir 24, resilient device 36 pushes head 32 axially along guide rod 30 in a direction away from cap 26, thereby forcing the fluid in the reservoir 24 toward the pump support section 20. O-ring 34 is stretched around the outer circumference of head 32 to prevent the fluid in reservoir 24 from seeping past head 32 during piston movement. Cap 26, guide rod 30, head 32, o-ring 34, and resilient device 36 form a piston subassembly 37 and are removable as one piece when the user unscrews the cap 26 to refill the reservoir 24 with fluid. Piston subassembly 37 is shown separately in FIG. 9. As the user screws the piston subassembly 37 back into reservoir 24, the distal end 33 of guide rod 30 is directed into a socket 70 of a hub 72.

Figure 3:
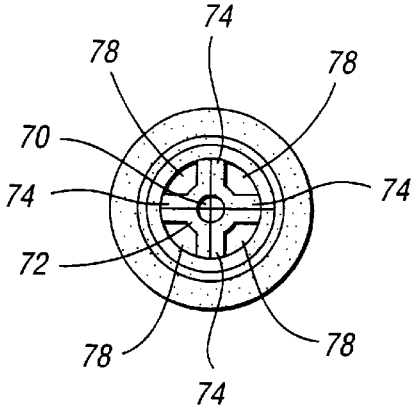
FIG. 3 is a cross-sectional view of the reservoir section taken along lines 3—3 in FIG. 2.

FIG. 3 shows a cross-sectional view through lines 3—3 in FIG. 2. The distal end 33 of the guide rod 30 is held in socket 70 located in the center of hub 72. Fluid from reservoir 24 flows pass hub 72 and spokes 74 toward the pump support section 20 through openings 78.

To prevent the piston head 32 from compressing the fluid and offering resistance to the user while the user is screwing the spring-loaded cap 26 into reservoir 24, a stop 38 is located on handle portion 16 as shown in FIG. 2. Stop 38 operates to prevent piston 28 from traveling through reservoir 24 toward the pump support section 20. Stop 38 includes button 40, pin 42, and resilient devices 44 and 46. Pin 42 is held in an inserted or actuated position as shown in FIG. 2 by a camming surface 47 of button 40 and resilient device or spring 44. When button 40 is moved toward extension tube 14, resilient device or spring 46 forces pin 42 up into indentation or cavity 48 and thereby out of the path of piston 28. To return stop 38 to the actuated position, the user needs only to move button 40 toward cap 26. The camming surface 47 will reinsert the pin 42.

Figure 10:
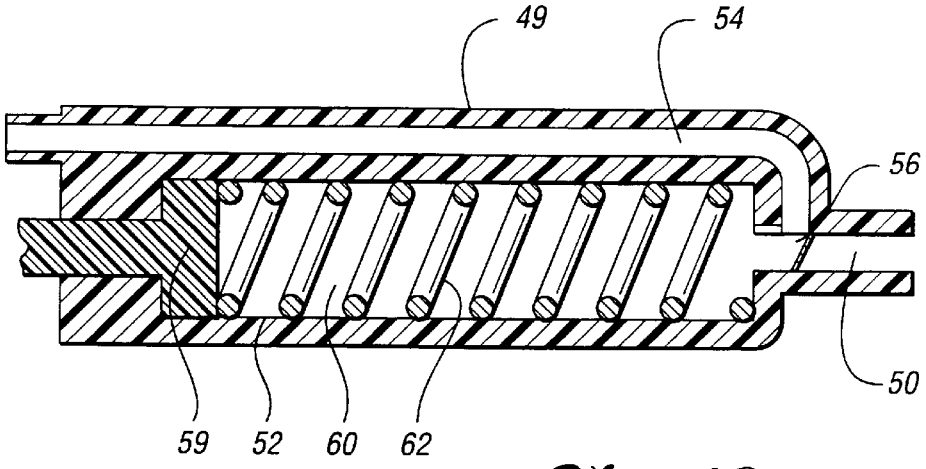
FIG. 10 is a cross-sectional view of the pump subassembly of the dispenser.

As shown in FIGS. 2 and 10, the pump support section 20 includes the extension tube 14, applicator head portion 12, and a pump subassembly 49. The pump subassembly 49 comprises an inlet passageway 50, a pump 52, an outlet passageway 54, and valve or flapper 56.

Figure 6:
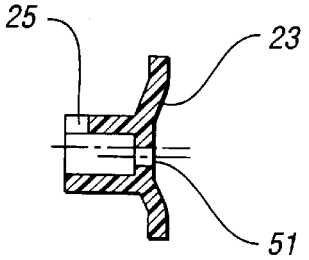
FIG. 6 is a cross-sectional view of a grommet used to locate the pump support section with respect to the fluid reservoir section.

As shown in FIGS. 2 and 6, the locator grommet 23 includes a port 51 which is aligned with the inlet passageway 50 and a notch 25 which fits over the outlet passageway 54 of the pump subassembly 49.

The pump 52 is formed from the actuating push button or trigger 18, a pump piston 59, a premeasure cavity 60, and a resilient device 62. Preferably, resilient device 62 is a spring or other like biasing device. The size of resilient device 62 is adapted to fit within premeasure cavity 60 and the strength of resilient device 62 is adapted to bias piston 59 and push button 18 to a loaded or unactuated position as shown in FIG. 2.

In the loaded position, resilient device 62 is fully expanded. In order to actuate the pump 52, mechanical force is supplied by the user to move push button 18 and pump piston 59 towards valve 56 thereby compressing resilient device 62 and forcing fluid from the premeasure cavity 60.

Figure 4:
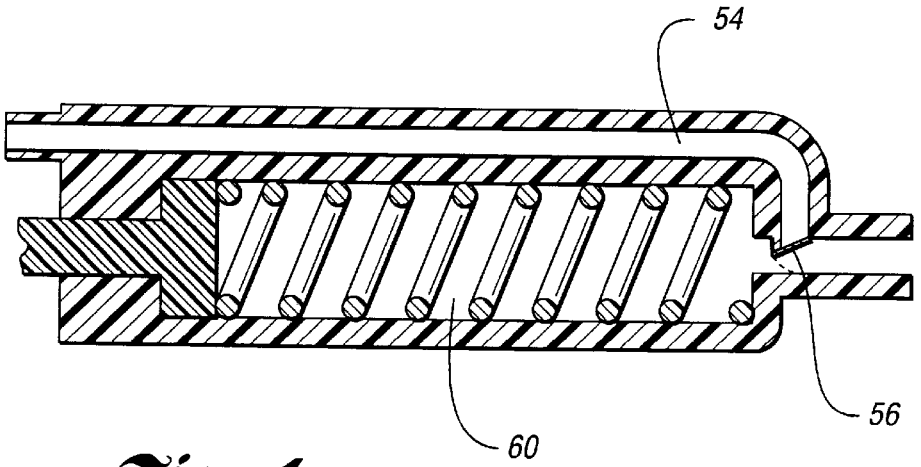
FIG. 4 is a cross-sectional view of a valve mechanism within the fluid delivery system.

FIG. 4 shows a cross-sectional view of a pump subassembly 49 and more specifically the operation of the valve 56 in directing fluid flow within the fluid dispenser. As shown in FIG. 4, the valve 56 is moveable to an open position, blocking fluid flow between the premeasure cavity 60 and outlet passageway 54 and establishing fluid flow communication between the reservoir 24 and premeasure cavity 60. As shown in FIGS. 2 and 10, the valve 56 is normally in a closed position, blocking fluid flow communication between premeasure cavity 60 and reservoir 24 and establishing fluid flow communication between premeasure cavity 60 and outlet passageway 54. Provided there is zero net pressure or force upon valve 56 it will rest in its normally closed position.

Figure 5:
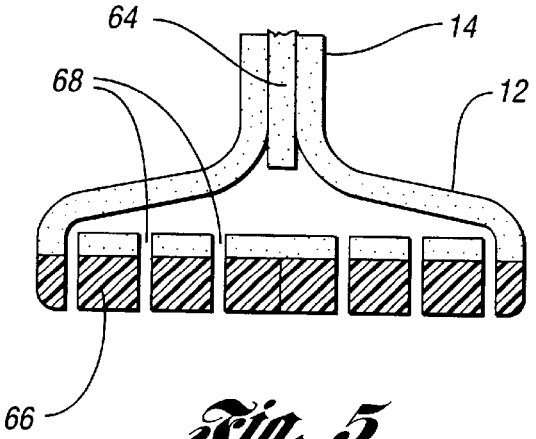
FIG. 5 is a cross-sectional view of an applicator head portion and an extension tube to show a fluid delivery path from the dispenser.

FIG. 5 shows a cross-sectional view of applicator head portion 12 and extension tube 14. An inner delivery tube 64 providing fluid flow communication from the outlet passageway 54 of the handle 16 to the applicator head portion 12, is located within extension tube 14. An applicator pad 66, preferably made of an absorbent sponge material or the like, is attached to the applicator head portion 12. Apertures 68 in applicator head portion 12 allow fluid from inner delivery tube 64 to be expelled or dispensed into applicator pad 66.

Figure 7:
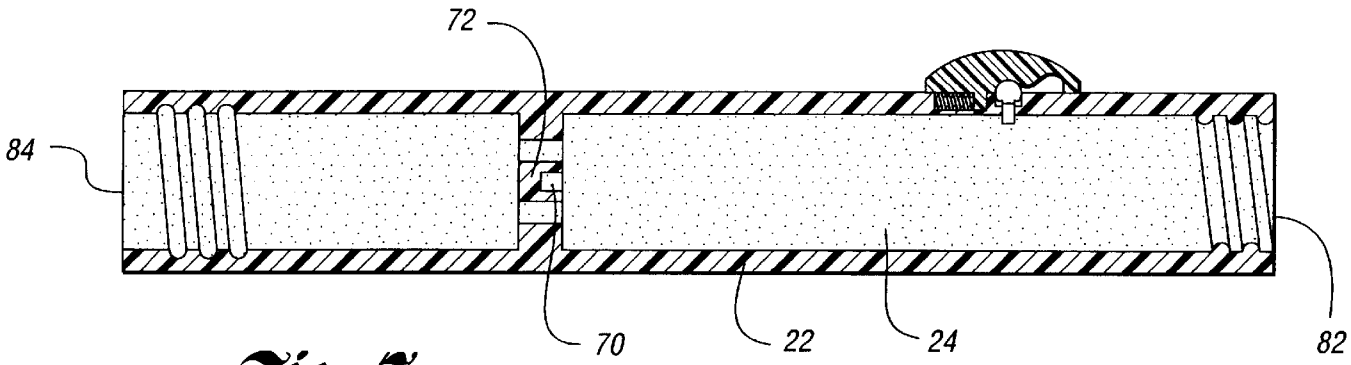
FIG. 7 is a cross-sectional view of the reservoir section of the dispenser.
Figure 9:
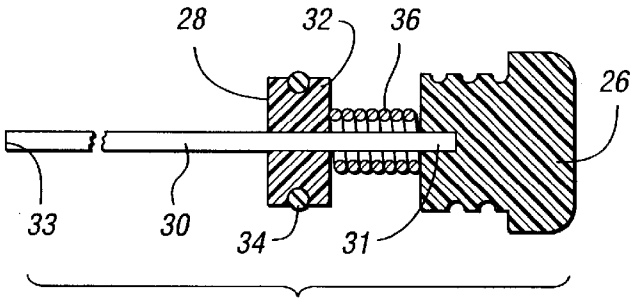
FIG. 9 is a fragmented cross-sectional view of the piston subassembly of the dispenser.
Figure 8:
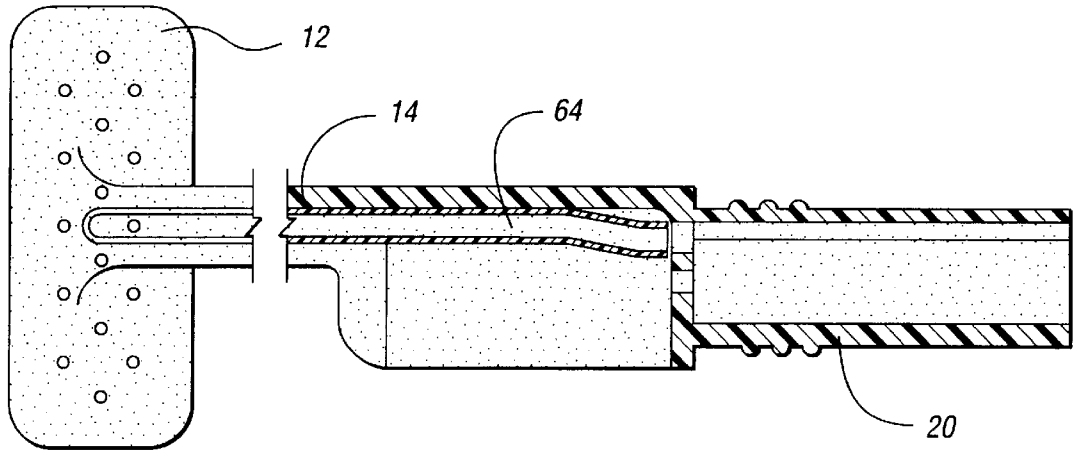
FIG. 8 is a cross-sectional view of the pump support section of the dispenser.

The fluid dispenser 10 is thus comprised of several subassemblies including the reservoir section 22 shown separately in FIG. 7, the pump support section 20 shown separately in FIG. 8, the piston subassembly 37 shown separately in FIG. 9, the pump subassembly 49 shown separately in FIG. 10, the locator grommet 23 shown separately in FIG. 6, and a gasket 80 shown in FIG. 2. The reservoir section 22 has a proximate end 82 and a distal end 84. To assemble the fluid dispenser, the piston subassembly 37 is screwed into the proximate end 82 of reservoir section 22. During this assembly, the distal end 33 of guide rod 30 is directed into socket 70 of hub 72. Gasket 80 is inserted in the distal end 84 of the reservoir section 22 and seated adjacent to hub 72. Locator grommet 23, indexed by notch 25, is inserted over the inlet passageway 50 of the pump subassembly 49. Pump subassembly 49 and locator grommet 23 are then loaded into the pump support section 20 with outlet passageway 54 of pump subassembly 49 being inserted into inner delivery tube 64 of the pump support section 20. The trigger 18 may then be fastened onto the protruding pump piston 59. Finally, the pump support section 20 is screwed in the distal end 84 of reservoir section 22 such that locator grommet 23 is pressed tightly against gasket 80.

Operation of the assembled fluid dispenser 10 is as follows. Referring to FIG. 2, when stop pin 42 is removed from the path of piston 28, the piston 28 is moved via the resilient device 36 such that the flow of fluid from reservoir 24 moves valve 56 from its normally closed position to its open position allowing fluid through the inlet passageway 50 and into premeasure cavity 60. Fluid from reservoir 24 continues to flow into premeasure cavity 60 until the cavity is filled with a first premeasured charge of fluid. At this point, the pressure in reservoir 24 equals the pressure in premeasure cavity 60 and valve 56 moves from its open position to its normally closed position.

As the push button 18 is moved by the user to the actuated position, the pump piston 59 forces the first charge of fluid from cavity 60. With valve 56 in its normally closed position, fluid flow from premeasure cavity 60 is directed into the outlet passageway 54.

After the first premeasured charge of fluid is expelled from cavity 60, and the push button 18 is released by the user, the biasing of piston 28 in reservoir 24 via the resilient device 36, and the biasing of the pump piston 59 to its unactuated position by resilient device 62, cooperate to move valve 56 back to its open position and deliver a second premeasured charge of fluid into the premeasure cavity 60. This second premeasured charge of fluid may be expelled from cavity 60 into outlet passageway 54 in the same manner as described above for the first premeasured charge of fluid. This process of filling and expelling premeasure cavity 60 is controlled by the user via push button 18 such that controlled amounts of a fluid, such as a soap solution, are expelled through the outlet passageway 54 through the inner delivery tube 64 and out the apertures 68 of the applicator head portion 12. While holding the handle 16, the user may thus use the applicator head portion 12 of the fluid dispenser 10 to apply and rub any desired fluid on various parts of the body, especially hard to reach spots such as the back.

To refill reservoir 24, piston subassembly 37 must be unscrewed from reservoir section 22. The user may then fill reservoir 24 with a chosen fluid. Prior to screwing piston subassembly 37 into the proximate end 82 of reservoir section 22, stop 38 must be moved to the actuated position.

Figure 11:
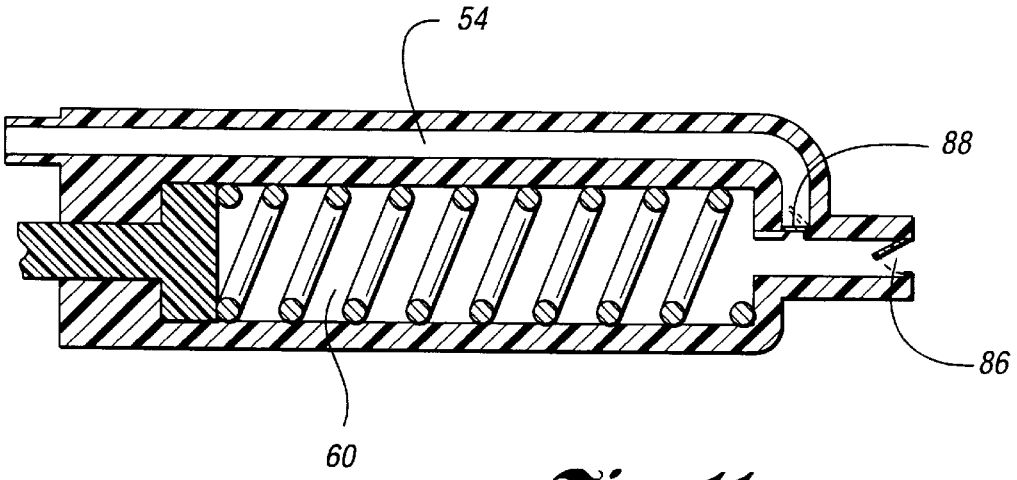
FIG. 11 is a cross-sectional view of a first alternative valve mechanism within the fluid delivery system.
Figure 12:
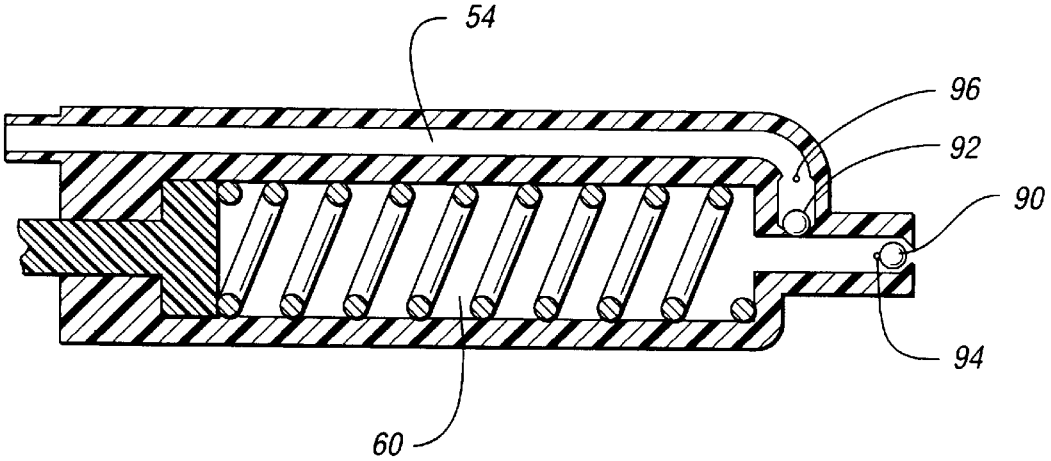
FIG. 12 is a cross-sectional view of a second alternative valve mechanism within the fluid delivery system.

FIGS. 11 and 12 show alternative valve mechanisms. In FIG. 11, valves or flappers 86 and 88 allow fluid to flow in only one direction from reservoir 24 to premeasure cavity 60 and from premeasure cavity 60 to outlet passageway 54 respectively. Valve 88 is biased such that the valve will only open when subject to pressure created when push button 18 is moved by the user to the actuated position. Valve 88 will not open when subject to pressure from reservoir piston 28 only. In FIG. 12, check balls 90 and 92 and peg stops 94 and 96, respectively, allow fluid to flow in only one direction from reservoir 24 to premeasure cavity 60 and from premeasure cavity 60 to outlet passageway 54 respectively. Check ball 92 is sized or biased such that the check ball will open only when subject to pressure created when push button 18 is moved by the user to the actuated position. Check ball 92 will not open when subject to pressure from reservoir piston 28 only.

It is to be understood, of course, that while the forms of the invention described above constitute the best mode contemplated of practicing the present invention, the preceding description is not intended to illustrate all possible forms of the invention. It is also to be understood that the words used are words of description, rather than of limitation, and that various changes may be made without departing from the spirit and scope of the present invention, which should be construed according to the following claims.

What is claimed is:

1. A fluid dispenser for applying a fluid, the dispenser comprising:

an applicator portion for applying the fluid;

a handle portion defining a pump support section and a reservoir section having a reservoir adapted to receive the fluid;

a pump supported in said pump support section having a premeasure cavity and inlet and outlet passageways in selective fluid flow communication respectively with said reservoir and said applicator portion;

a valve between said inlet and outlet passageways and movable to an open position blocking fluid flow communication between said premeasure cavity and said outlet passageway and establishing fluid flow communication between said premeasure cavity and said reservoir, said valve movable to a normally closed position blocking fluid flow communication between said premeasure cavity and said reservoir and establishing fluid flow communication between said premeasure cavity and said outlet passageway;

a first piston movable in said reservoir and having a first resilient device biasing said piston for pushing fluid from said reservoir to move said valve from its normally closed position to its open position so that fluid is allowed to flow from said reservoir to said premeasure cavity to fill said premeasure cavity with a first premeasured charge of fluid, said valve moving to its normally closed position after said premeasure cavity is filled;

a second piston movable in one direction in said premeasure cavity after said valve has moved to its normally closed position for pushing said first premeasured charge of fluid from said premeasure cavity through said outlet passageway to said applicator portion; and a second resilient device in said premeasure cavity for moving said second piston in a second direction and in cooperation with the bias of said first resilient device for again moving said valve to its open position so that a second premeasured charge of fluid can be sucked from said reservoir into said premeasure cavity.

2. The fluid dispenser of claim 1 wherein said valve includes a flapper hinged between said inlet and outlet passageways.

3. The fluid dispenser of claim 1 including a selectively insertable stop in said reservoir section selectively insertable into said reservoir into blocking engagement with said first piston to prevent movement of said first piston for pushing fluid from said reservoir.

4. The fluid dispenser of claim 1 including a locator grommet to locate said outlet passageway with respect to said in let passageway and an opening in said pump support section.

5. A fluid dispenser for applying a fluid, the dispenser comprising:

an applicator portion for applying the fluid;

a handle portion defining a pump support section and a reservoir section having a reservoir adapted to receive the fluid;

a pump supported in said support section having a premeasure cavity and inlet and outlet passageways in selective fluid flow communication respectively with said reservoir and said applicator portion;

a first valve establishing fluid flow communication from said reservoir to said premeasure cavity and blocking fluid flow communication from said premeasure cavity to said reservoir;

a second valve establishing fluid flow communication from said premeasure cavity to said outlet passageway and blocking fluid flow communication from said outlet passageway to said premeasure cavity;

a first piston movable in said reservoir and having a first resilient device biasing said piston for pushing fluid from said reservoir to open said first valve so that fluid is allowed to flow from said reservoir to said premeasure cavity to fill said premeasure cavity with a first premeasured charge of fluid;

a second piston movable in one direction in said premeasure cavity for pushing said first premeasured charge of fluid from said premeasure cavity thereby closing said first valve, opening said second valve, and forcing said premeasured charge of fluid through said outlet passageway to said applicator portion; and a second resilient device in said premeasure cavity for moving said second piston in a second direction and in cooperation with the bias of said first resilient device for opening said first valve and for sucking a second premeasured charge of fluid from said reservoir into said premeasure cavity.

6. The fluid dispenser of claim 5 wherein said first and second valves include flappers.

7. The fluid dispenser of claim 5 wherein said first and second valves include check balls and peg stops.

8. The fluid dispenser of claim 5 including a selectively insertable stop in said reservoir section selectively insertable into said reservoir into blocking engagement with said first piston to prevent movement of said first piston for pushing fluid from said reservoir.

9. The fluid dispenser of claim 5 including a locator grommet to locate said outlet passageway with respect to said inlet passageway and an opening in said pump support section.

10. The fluid dispenser of claim 1 further comprising a cap connectable with said handle portion, said cap supporting an axially extending rod, said first piston being supported on said rod and being moveable in said reservoir along said rod.

11. The fluid dispenser of claim 2 wherein said flapper is hinged at a surface helping to define both said inlet passageway and said outlet passageway.

12. The fluid dispenser of claim 3 wherein said stop includes a button, axially slidable between an unactuated position and an actuated position, and a pin, transversely slidable between an unengaged position and an engaged position, said button having a camming surface which is engageable with said pin for moving said pin between the engaged position and the unengaged position when said button is moved between the actuated position and the unactuated position.

13. The fluid dispenser of claim 4 wherein said locator grommet includes a radially extending wall and a cylindrical wall extending axially from said radially extending wall, said cylindrical wall having a notch and said radially extending wall having a port alignable with said inlet passageway.

14. The fluid dispenser of claim 5 further comprising a cap connectable with said handle portion, said cap supporting an axially extending rod, said first piston being supported on said rod and being moveable in said reservoir along said rod.

15. The fluid dispenser of claim 8 wherein said stop includes a button, axially slidable between an unactuated position and an actuated position, and a pin, transversely slidable between an unengaged position and an engaged position, said button having a camming surface which is engageable with said pin for moving said pin between the engaged position and the unengaged position when said button is moved between the actuated position and the unactuated position.

16. The fluid dispenser of claim 9 wherein said locator grommet includes a radially extending wall and a cylindrical wall extending axially from said radially extending wall, said cylindrical wall having a notch and said radially extending wall having a port being alignable with said inlet passageway.

17. A fluid dispenser for applying a fluid, the dispenser comprising:

a pump support section having an applicator portion for applying the fluid, an extension tube and a pump housing;

a reservoir section having a first end connectable with said pump support section, and a second end, the reservoir section comprising a housing having a portion which helps to define a reservoir for receiving fluid;

a piston subassembly connectable with said second end of said reservoir section, said piston subassembly comprising an end cap, a rod supported on said end cap, a first piston supported on said rod for sliding movement, and a first resilient device supported on said rod and positioned between said piston and said end cap;

a pump subassembly comprising a housing defining a premeasure chamber having inlet and outlet passageways, a second piston moveable in said premeasure chamber and a second resilient device, said pump subassembly being positionable in said pump support section and said reservoir section to enable said inlet and outlet passageways to be in selective fluid flow communication with said reservoir and said applicator portion; and a valve between said inlet and outlet passageways, said valve being movable to an open position blocking fluid flow communication between said premeasure cavity and said outlet passageway and establishing fluid flow communication between said premeasure cavity and said reservoir, said valve being further movable to a normally closed position blocking fluid flow communication between said premeasure cavity and said reservoir and establishing fluid flow communication between said premeasure cavity and said outlet passageway;

said first resilient device biasing said first piston for pushing fluid from said reservoir to move said valve from its normally closed position to its open position so that fluid is allowed to flow from said reservoir to said premeasure cavity to fill said premeasure cavity with a first premeasured charge of fluid, said valve moving to its normally closed position after said premeasure cavity is filled;

said second piston being movable in one direction in said premeasure cavity after said valve has moved to its normally closed position for pushing said first premeasured charge of fluid from said premeasure cavity through said outlet passageway to said applicator portion;

said second resilient device moving said second piston in a second direction and in cooperation with the bias of said first resilient device for again moving said valve to its open position so that a second premeasured charge of fluid can be sucked from said reservoir into said premeasure cavity.

* * * * *